US005174543A

United States Patent [19]

Corson et al.

[11] Patent Number: 5,174,543

[45] Date of Patent: Dec. 29, 1992

[54] TIPOVER PREVENTION APPARATUS FOR AN APPLIANCE

[75] Inventors: David N. Corson, Washington Township, Montgomery County; Michael W. Decker, Waldo Township, Marion County, both of Ohio

[73] Assignee: Whirlpool Corporation, Benton Harbor, Mich.

[21] Appl. No.: 812,391

[22] Filed: Dec. 23, 1991

[51] Int. Cl.[5] ..... F16M 1/00

[52] U.S. Cl. ..... 248/680; 248/500

[58] Field of Search ..... 312/245, 253; 248/500, 248/499, 493, 489, 680

[56] References Cited

U.S. PATENT DOCUMENTS

| | | | |
|---|---|---|---|
| 406,623 | 7/1889 | Brinkerhoff | 248/493 |
| 454,111 | 6/1891 | Coupe | 248/493 |
| 3,912,350 | 10/1975 | Gurubatham | 312/276 |
| 4,526,020 | 7/1985 | Fey et al. | 68/3 R |
| 4,566,665 | 1/1986 | Rynearson | 248/493 |
| 4,669,695 | 6/1987 | Chou | 248/500 |
| 4,754,948 | 7/1988 | Casciani | 248/680 |
| 4,826,193 | 5/1989 | Davis | 280/304.1 |
| 4,890,813 | 1/1990 | Johnson et al. | 248/680 |

FOREIGN PATENT DOCUMENTS

| | | | |
|---|---|---|---|
| 1023726 | 1/1978 | Canada | 248/489 |

OTHER PUBLICATIONS

Whirlpool Installation Instructions (Large capacity—Thin Twin Washer-Dryer) May 1, 1987.

*Primary Examiner*—Carroll B. Dority

*Attorney, Agent, or Firm*—Thomas J. Roth; Stephen D. Krefman; Thomas E. Turcotte

[57] ABSTRACT

A tipover prevention apparatus for an appliance includes a wall-mounted bracket which secures an appliance tether cable extending horizontally across the wall-facing side of the appliance. The bracket includes a plurality of downwardly extending hooks for removably securing the appliance tether cable, each of which hooks includes an interior relieved area in which the appliance tether cable is positioned. A pair of forwardly extending ridges located on the extreme right and left edges of the bracket impart tension to the appliance tether cable, maintaining the appliance tether cable in proper position.

4 Claims, 2 Drawing Sheets

TIPOVER PREVENTION APPARATUS FOR AN APPLIANCE

BACKGROUND OF THE INVENTION

The present invention is directed to a tipover prevention apparatus for an appliance, wherein a home appliance is mounted adjacent a vertical wall surface. A problem with current home appliances is the possibility of tipover if excess loads are applied to a door or other extension beyond the appliance base and the center of gravity of the appliance. Because of product safety concerns, the need to reduce manufacturing and shipping costs, and increasingly stringent regulatory requirements, a particular problem arises in the case of electric or gas freestanding ranges. A freestanding range typically includes an oven door which is hinged to the range about its lower edge. In an open position, the oven door is generally level with the surrounding range support surface, and is less than one foot from the surface. In this position, the door may be subjected to unintended heavy loads, which tend to cause the range to tip upwardly and forwardly, and, in extreme cases, to tip over completely. An example of such an unintended load is the instance where a falling person may intentionally or inadvertently land on the door, or use the door for support when recovering from a fall. Yet another example is the instance where one or more children step up on the open oven door to reach objects on the range cooktop or adjacent countertop.

In the present invention, a tether cable extends generally horizontally across the wall-adjoining surface of the appliance. The tether cable is removably secured by a wall bracket mounted on the wall, thereby preventing tipover of the appliance when excess loading is placed on the appliance door.

The use of a floor bracket in conjunction with an appliance for prevention of tipping is disclosed in presently pending U.S. patent application Ser. No. 07/294,307, Rutherford et al., assigned to the assignee of the present invention. A single floor-mounted bracket prevents tipping of the appliance by interfering with motion of an appliance foot when tipping is induced. However, no wall bracket is shown for removably securing an appliance to a wall by means of a tether cable extending generally horizontally across the wall-adjoining surface.

In U.S. Pat. No. 4,669,695, Chou, a wall bracket extending horizontally and mounted on a wall surface has two outwardly projecting end portions. Openings in the rear panel of an appliance accept the end portions, and interfere with upward motion of the appliance, whereby induced forward tipping of the appliance is prevented. A disadvantage to the disclosed design is the inability to use the bracket on an existing appliance, inasmuch as a tooling change is required to provide openings in the appliance rear panel. A further disadvantage to the disclosed design is the high material cost associated with such a large bracket.

In U.S. Pat. No. 4,754,948, Casciani, a pair of brackets are provided for preventing tipover in an appliance, in which each of the brackets is secured both to the appliance support surface and a wall surface. An end portion of each bracket projects outwardly from the wall surface. Openings in the rear panel of an appliance accept the end portions, and interfere with upward motion of the appliance, whereby induced forward tipping of the appliance is prevented. A disadvantage to the disclosed design is the inability to use the bracket on an existing appliance, inasmuch as a tooling change is required to provide openings in the appliance rear panel.

SUMMARY OF THE INVENTION

In accordance with the present invention, the disadvantages associated with prior tip prevention devices have been overcome.

In the present invention, a tether cable is secured on each end to opposing sides of the wall-adjoining surface of the appliance. The tether cable is preferably mounted on the upper one-third of the appliance for maximum effectiveness and ease of insertion into the wall bracket.

A wall bracket is centrally positioned on the wall in the location at which the appliance is to be placed. The wall bracket includes two parallel downwardly-projecting members or tether hooks that are generally centrally positioned on the wall bracket. A pair of outlying ridges aligned parallel to the downwardly-projecting tether hooks impart a tensioning force to the tether cable, thereby maintaining the tether cable in position beneath the tether hooks.

When the appliance is to be installed, the appliance is moved into a position adjacent the wall upon which the wall bracket is mounted, just short of an installed position. The tether is then manually secured to the wall bracket by inserting the tether cable beneath the two downwardly-projecting hooks. The pair of outlying ridges which are aligned parallel to the downwardly-projecting tether hooks automatically impart a tensioning force to the tether cable, thereby maintaining the tether cable in position beneath the tether hooks. Whereupon, the appliance may be moved the remaining distance to the wall, thereby concealing the wall bracket and tether cable from view of the ordinary observer.

An object of the present invention is the provision of a tipover prevention apparatus that may be installed on an existing appliance without requiring modification of the appliance.

Another object of the present invention is the provision of a tipover prevention apparatus that is economical to manufacture an install.

Yet another object of the present invention is the provision of a tipover prevention apparatus that is easily installed, however, once installed, reliably maintains its position.

Yet another object of the present invention is the provision of a tipover prevention apparatus that is hidden in normal use, yet is readily visible and accessible if the appliance is moved for cleaning, leveling, maintenance or other purposes.

DETAILED DESCRIPTION OF THE PREFERRED EMBODIMENTS

Figure 1:
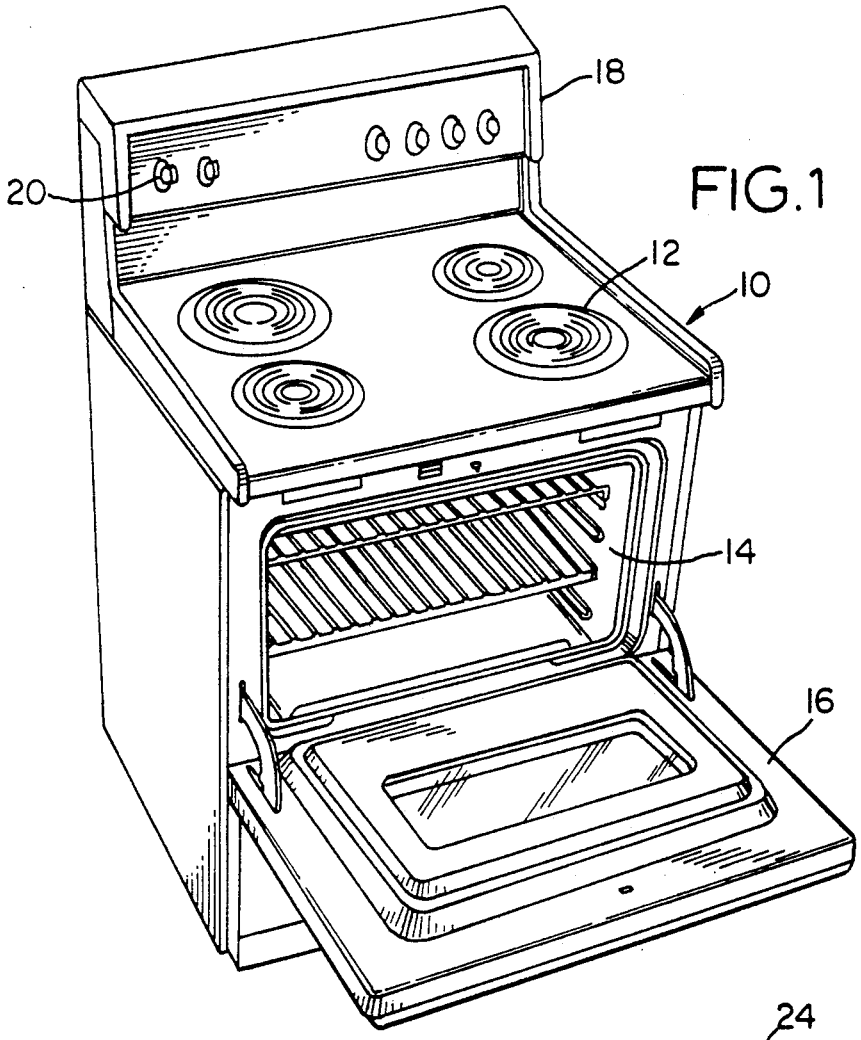
FIG. 1 is a front perspective view of an appliance for use with a tipover prevention apparatus embodying the principles of the present invention.

In accordance with the invention as shown in the drawings, and particularly as shown in FIG. 1, a free-standing range 1 0 includes a cooking surface having one or more surface units 12. While the invention disclosed herein is shown for use in a free-standing range, it may be used in any appropriate home appliance. Surface units 12 may be conventional electric surface units, gas burners, cast iron surface units, or other heat-generating means. Freestanding range 10 further includes an oven cavity 14, which includes an access opening coverable by oven door 16. Upstanding panel 18 located at the top rear portion of freestanding range 10 may include one or more control knobs 20.

Figure 2:
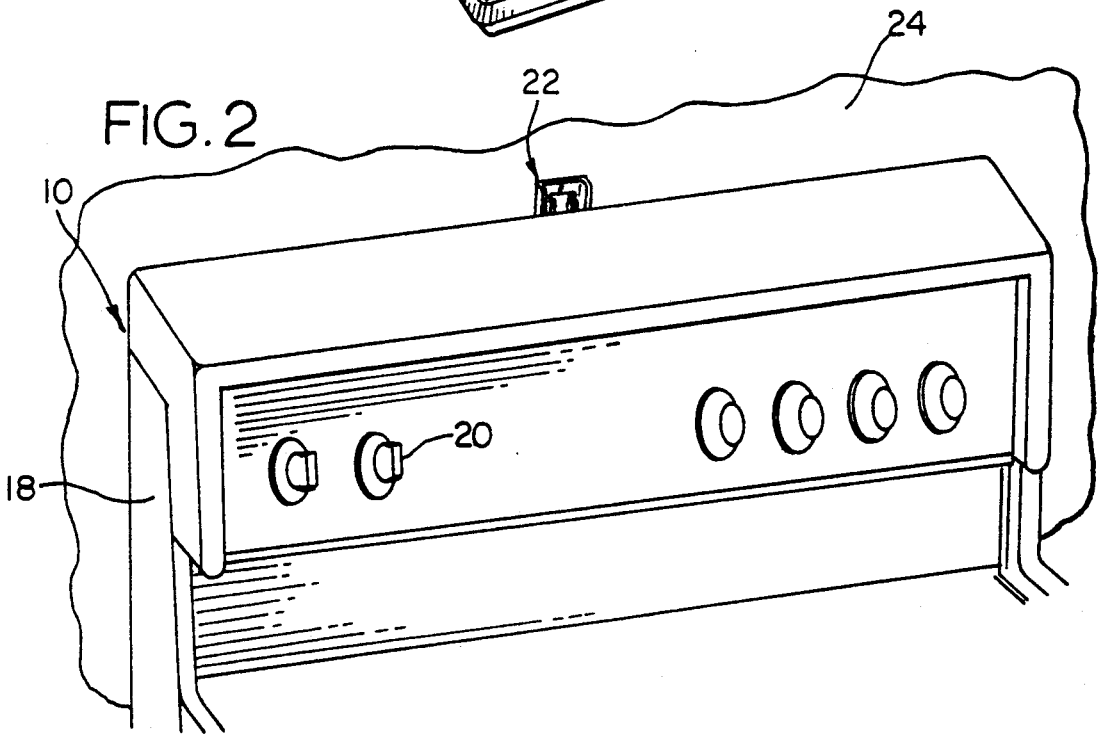
FIG. 2 is an enlarged perspective view of an appliance for use with a tipover prevention apparatus embodying the principles of the present invention.

As shown in FIG. 2, freestanding range 10 is located adjacent wall 24. Bracket 22 is shown mounted onto wall 24 and positioned generally centrally behind freestandinq range 10. In FIG. 2, freestanding range 10 is positioned away from wall 24 to permit viewing of bracket 22; in an installed position adjacent wall 24, freestanding range 10 conceals bracket 22 from front view.

Figure 3:
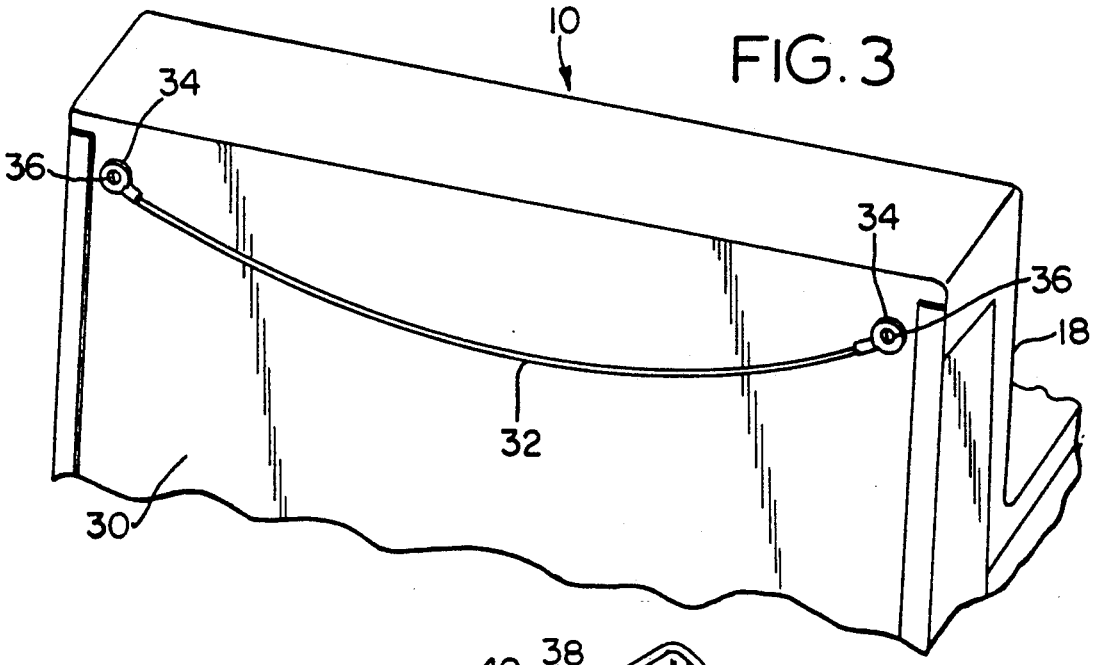
FIG. 3 is a rear perspective view of an appliance including a tipover prevention apparatus embodying the principles of the present invention.

As shown in FIG. 3, a tether cable 32 extends laterally across an upper portion of rear panel 30. Tether cable 32 may be a braided metal 7×7 cable, or other suitable cable. Tether cable 32 includes at its ends eyelets 34, which are secured to tether cable 32 by crimping or other suitable fastening methods. Fasteners 36, which may be sheet metal screws or other appropriate metal-engaging fasteners, secure eyelets 34 of tether cable 32 to rear panel 30. Tether cable 32 is appropriately dimensioned to enable use of existing fasteners 36 of rear panel 30.

Figure 4:
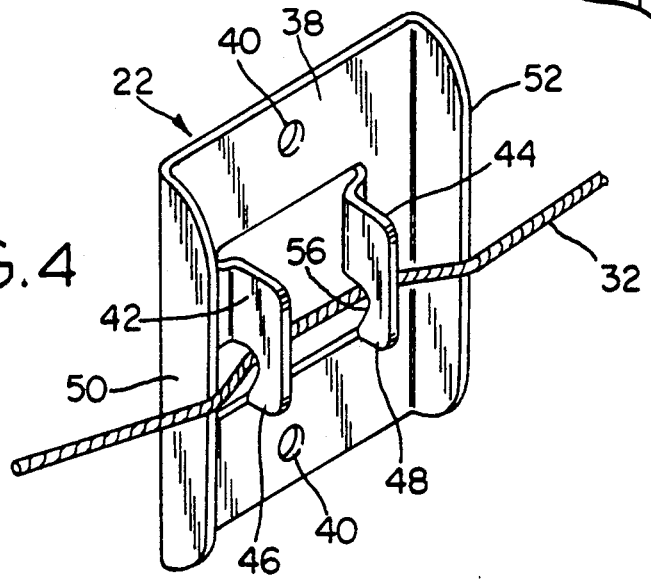
FIG. 4 is an isometric view of a wall bracket embodying the principles of the present invention.
Figure 5:
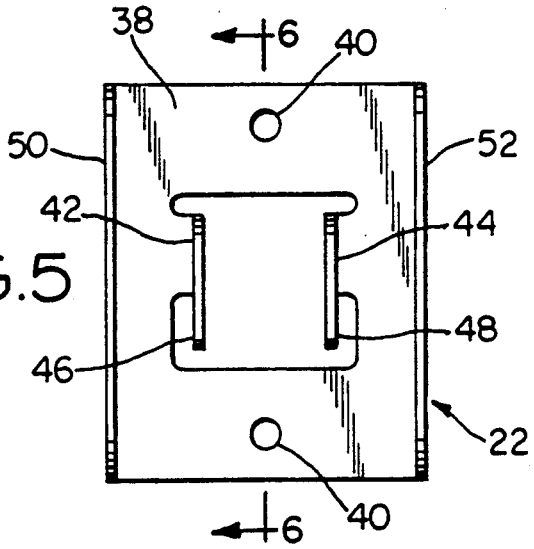
FIG. 5 is a plan view of a wall bracket embodying the principles of the present invention.
Figure 6:
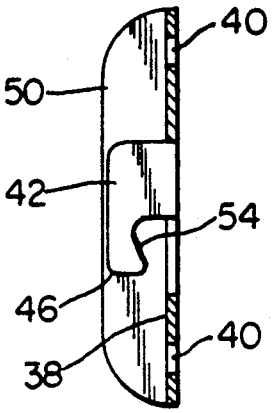
FIG. 6 is a cross-sectional view of a wall bracket embodying the principles of the present invention taken along lines 6—6 of FIG. 5.

As shown in FIGS. 4–6, bracket 22 includes a generally flat base 38, which provides a flat wall-contacting surface. Bracket 22 includes two through holes 40, each of which is located and dimensioned to receive a screw or other appropriate fastener (not shown), for mounting bracket 22 to wall 24. Bracket 22 may be formed from pretreated metal having a minimum thickness of 0.059 inches and manufactured using punch and form dies.

Base 38 has a centrally located, generally rectangular open area, which has, when viewed from the front, a left forwardly projecting member 42 and a right forwardly projecting member 44. The left forwardly projecting member 42 includes a downwardly depending member 46, which is generally rectangular in shape, for locating and retaining tether cable 32 therebehind. Correspondingly, the similarly-shaped right forwardly projecting member 44 includes a downwardly depending member 48, also for locating and retaining tether cable 32 therebehind. The two downwardly depending members 46 and 48 cooperate to provide a securing means for easily engaging tether cable 32, as is more fully described hereinafter.

Each of the two downwardly depending members further includes interior relieved areas, for providing positive retention of tether cable 32. As shown in FIG. 6, an interior relieved area 54 is located in the upper region of left downwardly depending member 46. A corresponding interior relieved area 56 is located in the upper region of right downwardly depending member 48.

Bracket 22 further includes a forwardly projecting left tensioning member 50 and a forwardly projecting right tensioning member 52. Each tensioning member 50 and 52 is formed by an elongate ridge extending the length of the bracket, located on the extreme left and right portions of bracket 22, respectively, and oriented vertically when bracket 22 is in an installed position. As shown in FIG. 6, left tensioning member 50 extends forwardly to a point just beyond forwardly projecting member 42. Similarly, right tensioning member 52 extends forwardly to a point just beyond forwardly projecting member 44.

In order to properly install the tipover prevention apparatus, bracket 22 must first be appropriately positioned and secured to wall 24. Freestanding range 10 is then moved to a position adjacent wall 24 sufficiently close to bracket 22 so that tether cable 32 may be secured thereto, however, sufficiently far from wall 24 so that tether cable 32 may be easily manipulated. Forwardly projecting members 46 and 48 cooperate with each other and with tensioning members 50 and 52 to effectively retain tether cable 32, while allowing tether cable 32 to be easily positioned within bracket 22.

To secure tether cable 32 to bracket 22, tether cable 32 is grasped and drawn to a position at the center of bracket 22 and immediately below downwardly depending members 46 and 48, and contacting tensioning members 50 and 52. Tether cable 32 is then pressed inwardly to bracket 22, and upwardly, to the point that tether cable 32 is secured by downwardly depending members 46 and 48. When pressure is released, tether cable 32 relaxes and is retained within interior relieved areas 54 and 56.

Whereupon, freestanding range 10 may be moved to a final installed position immediately adjacent wall 24. When freestanding range 10 is in the installed position, a small amount of slack is induced in tether cable 32. To prevent tether cable 32 from becoming dislocated, tensioning members 50 and 52 act jointly to maintain tether cable 32 in place.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

What is claimed is:

1. In a cooking appliance locatable adjacent a wall surface, a tipover prevention apparatus comprising:

a bracket having a base, said base including a first wall-contacting side for mounting said bracket to said wall surface, means located on said base opposite said wall-contacting side for removably securing an appliance tether cable to said bracket, said bracket including means for tensioning said appliance tether cable, preventing displacement of said appliance tether cable therefrom, said means for removably securing an appliance tether cable to said bracket including at least one securing member projecting from said bracket, with said appliance tether cable removably secured thereby, said at least one securing member including a portion which is oriented in a downwardly directed position when said bracket is mounted on said wall, with said appliance tether cable removably secured therebehind, said at least one securing member consisting of two appliance tether cable-securing members in spaced parallel relationship to one another, said tensioning means consisting of two appliance tether cable-tensioning members in spaced parallel relationship to one another, said two appliance tether cable-tensioning members being located at the extreme left and right edges of the bracket, respectively, and defining a bracket interior area, in which area said appliance tether cable-securing members are located, said appliance tether cable-securing members being aligned parallel to said appliance tether cable tensioning members, said two appliance tether cable-tensioning members extending forwardly beyond said two appliance tether cable-securing members.

2. The tipover prevention apparatus of claim 1 wherein said bracket is a pretreated metal bracket.

3. The tipover prevention apparatus of claim 1 wherein said appliance tether cable is a braided metal cable.

4. The tipover prevention apparatus of claim 1 wherein said appliance tether cable includes two ends, each of said ends having crimpled thereon an eyelet, said eyelets each being removably securable to said cooking appliance.

* * * * *